US006012024A

United States Patent [19]

Hofmann

[11] Patent Number: 6,012,024

[45] Date of Patent: Jan. 4, 2000

[54] METHOD AND APPARATUS IN CODING DIGITAL INFORMATION

[75] Inventor: Rudi Hofmann, Forchheim, Germany

[73] Assignee: Telefonaktiebolaget LM Ericsson, Stockholm, Sweden

[21] Appl. No.: 08/875,730

[22] PCT Filed: Feb. 2, 1996

[86] PCT No.: PCT/SE96/00128

§ 371 Date: Aug. 4, 1997

§ 102(e) Date: Aug. 4, 1997

[87] PCT Pub. No.: WO96/24926

PCT Pub. Date: Aug. 15, 1996

[30] Foreign Application Priority Data

Feb. 8, 1995 [SE] Sweden ..... 95000452

[51] Int. Cl.[7] ..... G10L 9/14; G10L 3/00

[52] U.S. Cl. ..... 704/219; 704/220; 704/201

[58] Field of Search ..... 704/201, 212, 704/219, 262, 221, 222, 223, 208, 210, 214, 215, 220; 370/433, 435

[56] References Cited

U.S. PATENT DOCUMENTS

| | | | |
|---|---|---|---|
| 4,100,377 | 7/1978 | Flanagan | 370/435 |
| 4,747,096 | 5/1988 | Piasecki et al. | 370/81 |
| 4,860,313 | 8/1989 | Shpiro | 375/27 |
| 4,899,385 | 2/1990 | Ketchum et al. | 381/36 |
| 4,910,781 | 3/1990 | Ketchum et al. | 381/36 |
| 4,969,192 | 11/1990 | Chen et al. | 381/31 |
| 5,117,453 | 5/1992 | Piasecki et al. | 379/100 |
| 5,226,085 | 7/1993 | Di Francesco | 381/51 |
| 5,228,076 | 7/1993 | Hopner et al. | 379/96 |
| 5,233,660 | 8/1993 | Chen | 381/38 |
| 5,235,669 | 8/1993 | Ordentlich et al. | 395/2 |
| 5,313,554 | 5/1994 | Ketchum | 395/2.28 |
| 5,327,520 | 7/1994 | Chen | 395/2.28 |
| 5,339,384 | 8/1994 | Chen | 395/2.2 |
| 5,475,712 | 12/1995 | Sasaki | 704/215 |
| 5,539,858 | 7/1996 | Sasaki et al. | 704/215 |

FOREIGN PATENT DOCUMENTS

| | | | |
|---|---|---|---|
| 0 251 986 | 1/1988 | European Pat. Off. | H04Q 5/02 |
| 0 379 296 | 7/1990 | European Pat. Off. | G10L 9/14 |
| 0 530 034 | 3/1993 | European Pat. Off. | H04N 1/46 |

OTHER PUBLICATIONS

JP Abstract 04129466.
JP Abstract 03283985.
JP Abstract 06–97833.
JP Abstract 04–29442.
JP Abstract 02–26426.
JP Abstract 06–6295.

(List continued on next page.)

*Primary Examiner*—David R. Hudspeth
*Assistant Examiner*—Abul K. Azad
*Attorney, Agent, or Firm*—Burns, Doane, Swecker & Mathis, L.L.P.

[57] ABSTRACT

A speech encoder (100) receives speech signals (S) which are encoded and transmitted on a communication channel (120). Silence in the speech is utilized by a data encoder (101) to transmit data on the speech frequency band via the channel (120). A signal classifier (103) switches between the encoders (100, 101). The speech encoder has synthesis filter (115) with state variables in a delay line, predictor adaptor (116), gain predictor (113, 114) and excitation codebook (112). The data encoder (101) has delay line with state variables stored and updated in a buffer (192). On switching (103, 102, 193) from data to speech, the buffer state variables are fed into the synthesis filter delay line via an input (144) for smooth transition in the speech encoding. Coefficient values in the synthesis filter (115) and an excitation signal (ET(1 . . . 5)) are generated. Thereby a buffer in the gain predictor (113, 114) is preset and its predictor coefficients and gain are generated. The incoming speech signal (S) newly detected is encoded (CW) by the values generated in the speech encoder (100), which is successively adapted. The receiver side has corresponding speech and data decoders.

24 Claims, 11 Drawing Sheets

OTHER PUBLICATIONS

"Coding of Speech at 16kbit/s Using Low–Delay Code Excited Linear Prediction", International Telecommunication Union, Recommendation G.728, Sep., 1992.

"Pulse Code Modulation (PCM) of Voice Frequencies", International Telecommunication Union, Recommendation G.711, 1993.

40, 32, 24, 16 kbit/s Adaptive Differential Pulse Code Modulation (ADPCM), International Telecommunication Union, Recommendation G.726, 1990.

Haykin, Simon, "Digital Communications", John Wiley & Sons, Inc., 1988.

Kataoka, Akitoshi, et al., "A Backward Adaptive 8kbit/s Speech Coder Using Conditional Pitch Predition", IEEE Global Telecommunications Conference, vol. 3, Dec., 1991, pp. 1889–1893.

METHOD AND APPARATUS IN CODING DIGITAL INFORMATION

TECHNICAL FIELD OF THE INVENTION

The invention is related to speech coding techniques and general speech processing. More particularly, it is related to speech coding methods based on analysis by synthesis schemes in combination with backward adaptation techniques.

DESCRIPTION OF RELATED ART

A system based on analysis by synthesis and backward adaptation is used for instance in the Low-Delay Code Excited Linear Prediction (LD-CELP) speech codec, that was recently standardised by the International Telecommunication Union (ITU) in the publication "CODING OF SPEECH AT 16 kbit/s USING LOW-DELAY CODE EXCITED LINEAR PREDICTION", copyright by ITU 1992, recommendation G.728. This speech signal compression algorithm is meanwhile well known under the speech coding experts all over the world.

Digital networks are used to transmit digitally encoded signals. In the past mainly speech signals were to be transmitted. Now the data traffic caused by a wide spread use of electronic mailing networks is worldwide growing more and more. From an economical stand point, the number of connected users must be maximized without network congestion. As a consequence, speech compression algorithms have been developed specially optimized by utilizing noise masking effects. Unfortunately, these coding algorithms are not well suited for the transmission of voiceband data signals. So the idea is to add signal classification algorithms and to use a suitable voiceband data signal compression algorithm, hereinafter referred to as VDSC algorithm when data signals are detected. Currently a 16 kb/s-Digital-Circuit-Multiplication-Equipment (DCME) transmission system is being standardised using this idea. The LD-CELP codec will be used for transmission of speech whereas for voiceband data transmission a new coding algorithm is being under development within ITU.

In practical applications the signal classification algorithm may fail resulting in more or less frequent switching between different coding schemes. If the next coding scheme would always start from the reset state this may not be critical during transmission of voice band data. However, when speech is currently being transmitted this would result in rather annoying effects.

In order to overcome this problem in 16 kb/s DCME systems it was proposed to keep the LD-CELP architecture also for voiceband data signal compression. Only the bit rate should be increased for example by providing larger shape codebooks in order to ensure sufficient quantization. With such a method a continuous shape of the time signal would be guaranteed when switching from one coding mode to the other.

The drawback of this solution is twofold: on the one hand, the computational load would be increased significantly during transmission at higher bit rates. This makes implementations not very attractive as the conventional LD-CELP requires nearly the complete computation power of digital signal processors (DSPs) which are currently offered on the market. On the other hand, it is very likely that the coding of voiceband data signals can be done much more efficiently with specially optimised architectures resulting in bit rates below 40 kb/s or higher performance. Hitherto, 40 kb/s seems to be the required bitrate for compressions algorithms used with voiceband data signals. It is trivial to mention that this switching problem also arises if already existing signal compression algorithms are used in combination with LD-CELP type codecs. Known systems are using for example the algorithms according to ITU rec. G.711 (64 kb/s) or G.726 (32 kb/s or 10 kb/s) when voice band data signals have to be transmitted.

In this connection a coding algorithm, named ADPCM, the structure of which has similarities to the LD-CELP in that it includes forward error correction. Reference is made to the document "Digital Communications" by Simon Haykin, John Wiley & Sons, 1988.

In the patent U.S. Pat. No. 5,233,660 is disclosed a low-delay digital speech encoder and decoder based on code excited linear prediction (LD-CELP). The coding includes backward adaptive adjustment for codebook gain and short-term synthetis filter parameters and also includes forward adaptive adjustment of long-term synthetis filter parameters. An efficient, low-delay pitch parameter derivation and quantization permits an overall delay which is a fraction of prior coding delays for equivalent speech quality.

In the patent U.S. Pat. No. 5,339,384 is also disclosed a CELP coder for speech and audio transmission. The coder is adapted for low-delay coding by performing spectral analysis of a portion of a previous frame of simulated decoded speech to determine a synthesis filter of a much higher order than conventionally used for decoding synthesis and then transmitting only the index for the vector which produces the lowest internal error signal. Modified perceptual weighting parameters and novel use of postfiltering improves tandemning of a number of encodings and decodings while retaining high quality reproduction.

Also the patent U.S. Pat. No. 5,228,076 is of interest since it includes use of the abovementioned ADPCM coding algorithm.

SUMMARY

During e.g. speech transmission a considerable part of the transmission time is silence. During this silenced intervals it is possible to use the transmission link for transmitting data. Data and speech are coded by different codes and a problem is to switch between different coders and avoid discontinuities in the speech after the switching. This is the case especially for backward adaptive coding schemes. Also in transmission of other types of information than speech, time intervals can occur which can be used for the transmission of alternative information on the same channel.

Discontinuities in the output signal can be eliminated if the states of the coding scheme, which is to be activated, are being pre-set with the same values as if this coding scheme would already have been active in the past. The problem is that the generating of the corresponding initial values of the state variables is not trivial when the codec is based on backward adaptive schemes, as in the LD-CELP type coding scheme. The predictor coefficients depend on the past quantized output signal, as coefficients of a synthesis filter in the LD-CELP type coding scheme. Additionally states and predictor coefficients depend on the past quantised excitation signal, as coefficients in a gain predictor depend on an excitation signal of a synthesis filter in the LD-CELP. More specific the problem is that this past excitation signal is not available when the codec is to be switched on. Even if the state variables can be retrieved there would be a demand for enormous instantaneous signal processing power at the time where the codec is to be initialised. This processing would exhaust all DSPs currently available on the market.

The present invention discloses the techniques how to retrieve the state variables and shows the ways of reducing the required signal processing or computation power allowing practicable implementations. The problem is solved by using output samples from ore coder, which is switched off, to pre-set the states of the coding scheme for a parallel coder, which is switched on.

More in detail the problem is solved by generating coefficient values from the pre-set state values and restoring a signal sequence (vector) from these coefficient values and the signal sequence. This signal sequence (vector) is utilised for direct generating the decoded output, e.g. speech, in the decoder and also in the encoder and is normally generated successively during the transmission. By restoring the signal sequence (vector) the codec is started up rapidly.

In a simplified embodiment the coefficient values are not generated in the codec but transferred directly from the parallel codec that is switched off. The transferred coefficients are used for the restoring of the signal sequence (vector).

It is an object of the present invention to provide appropriate means and methods allowing backward adaptive speech coding schemes, like LD-CELP type speech codecs, to be activated by keeping a continuous shape of the reconstructed output signal. Modifications are also being presented so that the signal processing load around the initialisation phase can be kept reasonable low.

The advantages of the invention is that only a moderate signal processing power is required when switching to a codec, and the switching can be performed without heavy discontinuities in the output signal. When transmitting speech and data on the same communication channel, no annoying effects are observed in the speech when switching to the speech coder.

DETAILED DESCRIPTION OF EMBODIMENT

Figure 1:
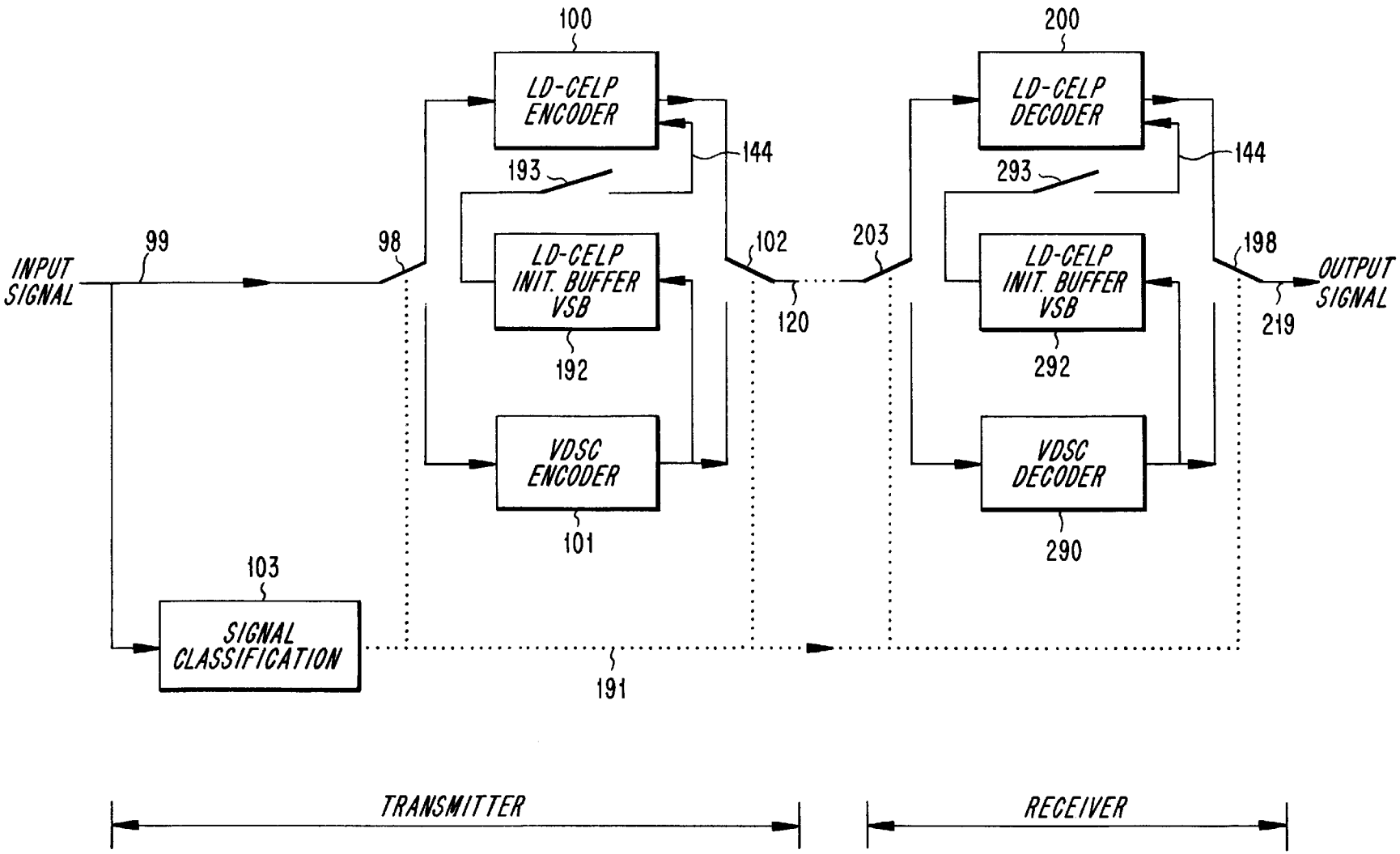
FIG. 1 illustrates in a high level block diagram a transmission system comprising two different codecs which are being used for different purposes.

For describing the preferred embodiment of the invention it is useful to explain some details of backward adaptive speech coding schemes as used for example in the LD-CELP algorithm. FIG. 1 illustrates, in block diagram form, a transmission system with different coding schemes for speech signals and voice band data signals. On the transmitter side there is an encoder 100 for LD-CELP coding speech and a VDSC data encoder 101. An input line 99 is connected to the encoders by a switch 98 and the output of the encoders are connected to a communication channel 120 by a switch 102. A signal classification device 103 is connected to the input line 99 and controls the switches 98 and 102. On the receiver side there is a decoder 200 for speech decoding and a data decoder 290. The decoders are connected to the communication channel by a switch 203 and their outputs are connected to an output line 219 by a switch 198. The signal classification device 103 is connected to the switches 203 and 198 by a separate signalling channel 191 and controls these switches paralelly with the switches on the transmitter side. A buffer 192 is connected to an extra output of the data encoder 101 and is connected to an input 144 of the speech encoder 100 via a switch 193. This switch is activated by the signal classification device 103. On the receiver side there is a corresponding buffer 292 and a switch 293. As an examplifying embodiment the speech codec 100 is of type LD-CELP and is being used when speech is to be encoded, whereas another coding scheme VDSC is used in the data encoder 101 when voice band data signals are present. The information on the currently used compression scheme is usually passed form the transmitter to the receiver over the separate signalling channel 191. The invention is related to the situation where the coding scheme VDSC has been active and the signal classification device just having detected the presence of speech. This results in activating the LD-CELP type speech codec 100 and 200.

Figure 2:
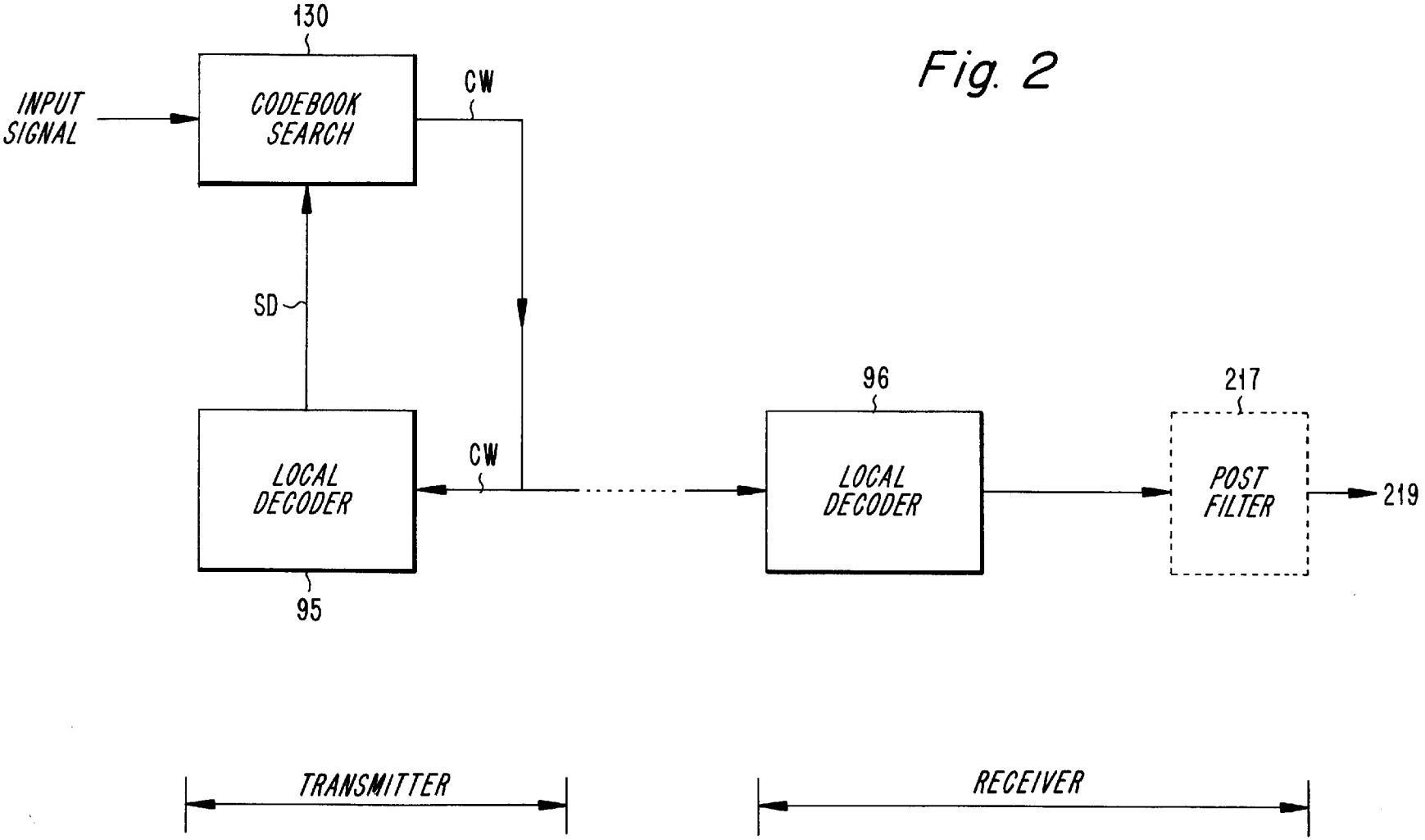
FIG. 2 illustrates in a high level diagram a general speech coding scheme based on backward adaptation techniques.

FIG. 2 illustrates on a very high level the basic principle of a backward adaptive speech coding scheme as is used for example in the LD-CELP. On the transmitter side there is a codebook search unit 130 and a local decoder 95. The local decoder 95 is connected to an input of the codebook, which has also an input for an input signal. An output from the codebook search unit is connected to the input of the local decoder. The transmitter transmits a codevector CW to the receiver. On the receiver side there is a local decoder 96 connected to a postfilter 217, which in turn is connected to the output 219.

On both the transmitter and the receiver side, the quantized output signal is being reconstructed in block 'Local Decoder' 95 respectively 96. On the transmitter side, the known states of the past reconstructed signal is used in order to find optimised parameter for a current speech segment to be encoded, as will be described more in detail below.

Figure 3A:
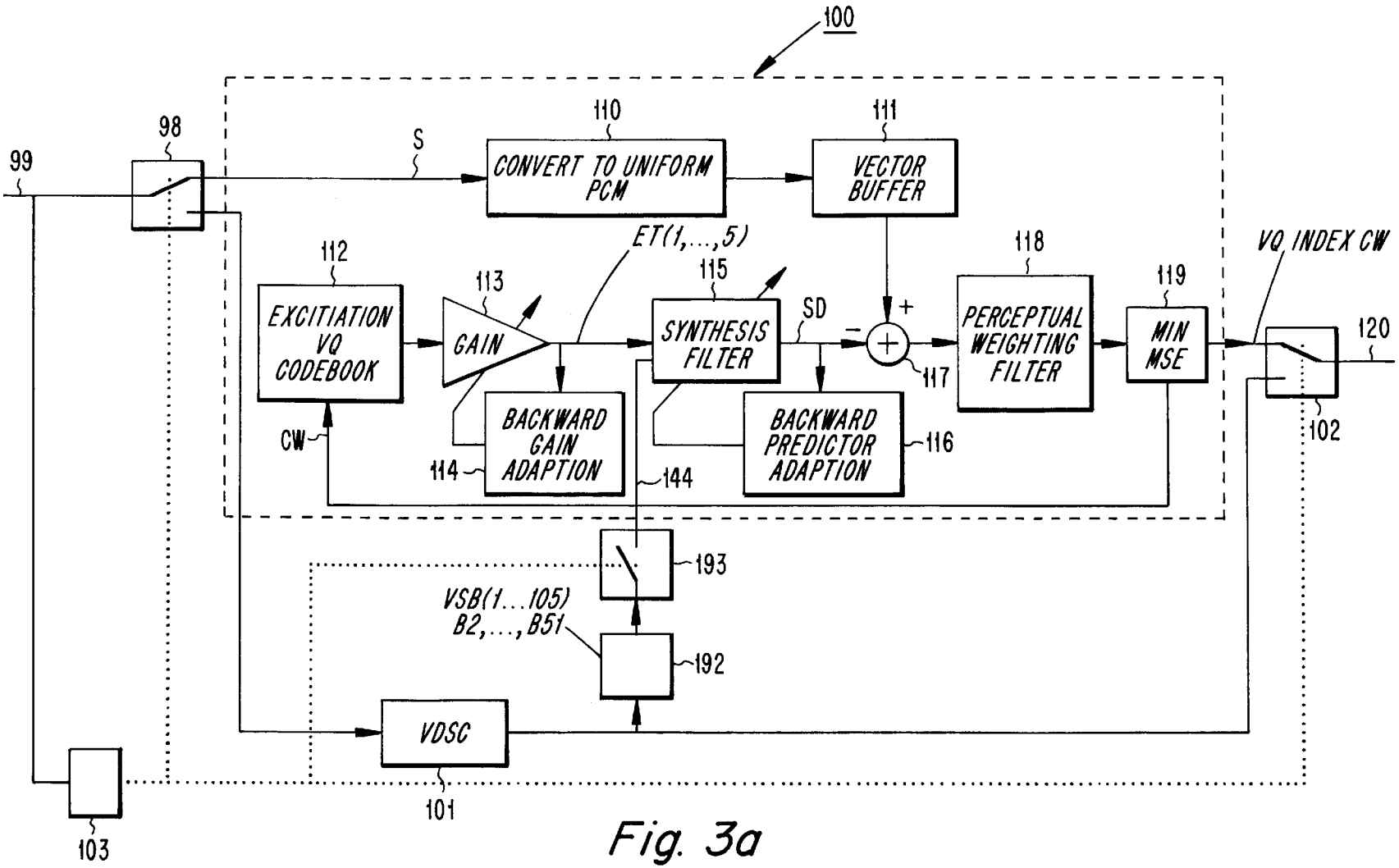
FIG. 3*a* shows a block diagram of a LD-CELP encoder.

FIG. 3*a* shows a simplified block diagram of the LD-CELP encoder 100 and also the VDSC encoder 101. The switches 102 and 98 for selecting encoder 100 or 101 and the signal classification circuit 103, controlling the switches 98 and 102, are also shown as well as the buffer 192 and the switch 193. The incoming signal S is connected to the signal classification circuit 103 and to the LD-CELP encoder 100. The LD-CELP encoder includes a PCM converter 110 connected to a vector buffer 111. The encoder 100 also includes a first exitation codebook memory 112 connected to a first gain scaling unit 113 with a first backward gain adapter 114. The output of the first gain scaling unit: 113 is connected to a first synthesis filter 115 having an input 144 and being connected to a first backward predictor adaptation circuit 116. The output of the synthesis filter 115 is connected to a difference circuit 117 to which also the vector buffer 111 is connected. The difference circuit 117 in turn is connected to a perceptual weighting filter 118, the output of which is connected to a mean-squared error circuit 119. The latter is connected to the excitation codebook memory and to the communication channel 120 connecting the LD-CELP encoder 100 with the LD-CELP decoder 200 on the receiver side of the transmission, shown in FIG. 3*b*.

Figure 3B:
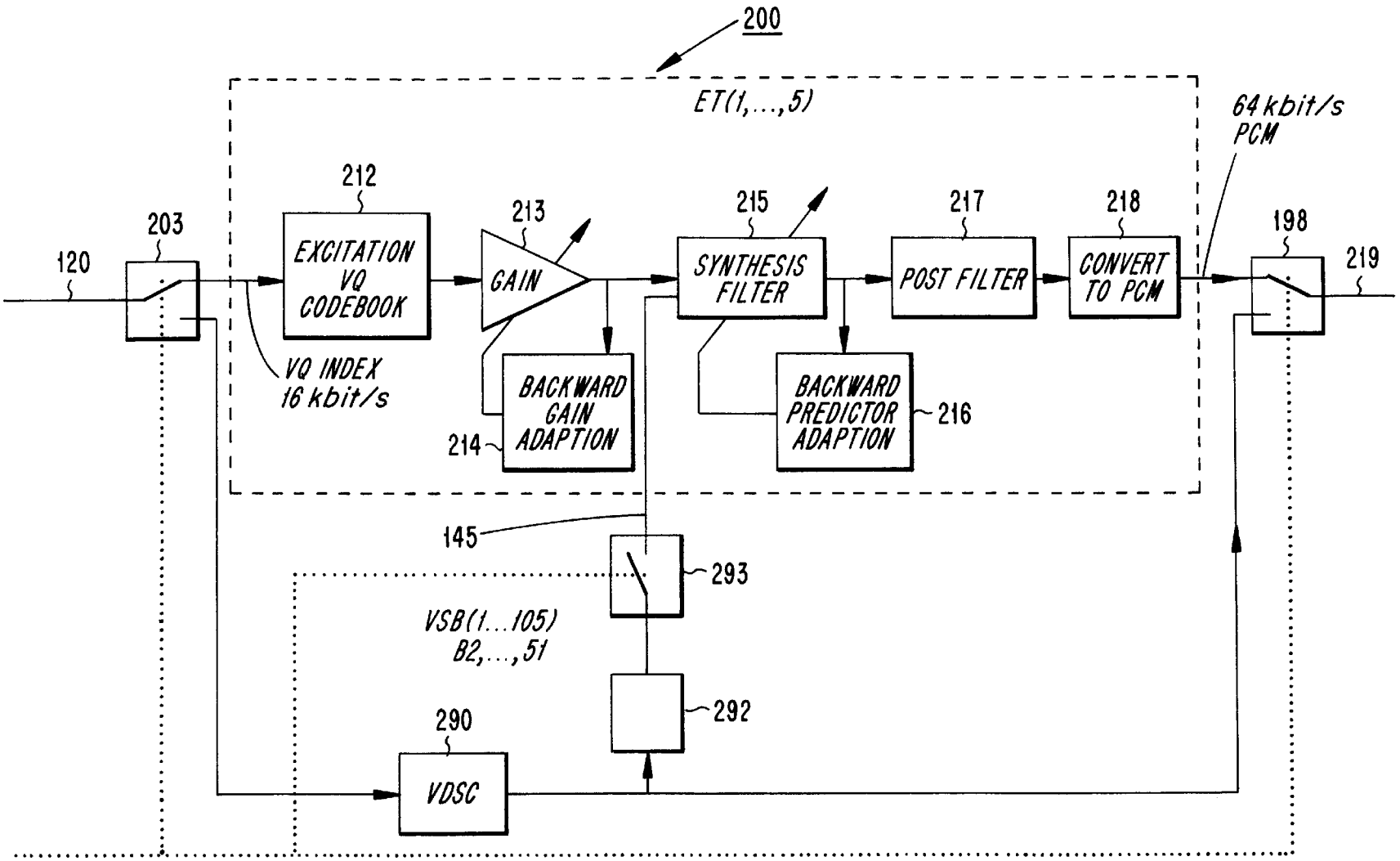
FIG. 3*b* shows a block diagram of a LD-CELP decoder.

FIG. 3*b* shows the VDSC decoder 290 with the switches 198 and 203 and also buffer 292 with the switch 293. The LD-CELP decoder includes a second exitation codebook store 212 connected to the communication channel 120 and to a second gain scaling circuit 213 with a second backward gain adapter 214. The second gain circuit 213 is connected to a second synthesis filter 215 having an input 145 and being connected to a second backward predictior adaption circuit 216. An adaptive postfilter 217 is connected with its input to the synthesis filter 215 and with its output to a PCM converter 218 with a A-law or $\mu$-law PCM output 219.

The LD-CELP encoder 100 operates in the following manner. The PCM A-law or $\mu$-law converted signal S is converted to uniform PCM in converter 110. The input signal is then partitioned into blocks of five consecutive input signal samples, named input signal vectors, stored in the vector buffer 111. For each input signal vector the encoder passes each of 128 candidate codebook vectors, stored in the codebook 112, through the first gain scaling unit 113. In this unit each of the vectors are multiplied by eight different gain factors and the resulting 1024 candidate vectors are passed through the first synthesis filter 115. An error generated in the difference circuit 117, between each of the input signal vectors and the 1024 candidate vectors, is frequency-weighted in the weighting filter 118 and mean-squared in circuit 119. The encoder identifies a best code vector, i.e. the vector that minimizes the mean-squared error for one of the input signal vectors and a 10-bit codebook index CW of the best code vector is transmitted to the decoder 200 over the channel 120. The best code vector is also passed through the first gain scaling unit 113 and the first synthesis filter 115 to establish the correct filter memory in preparation for the encoding of the next coming input signal vector. The identifying of best code vector and updating of filter memory is repeated for all the input signal vectors. The coefficients of the synthesis filter 115 and the gain in the first gain scaling unit are updated periodically by the adaptation circuits 116 respective 114 in a backward adaptive manner based on the previously quantized signal and gain-scaled excitation.

The decoding in decoder 200 is also performed on a block-by-block basis. Upon receiving each 10-bit codebook index CW on the channel 120, the decoder performs a table look-up to extract the corresponding code vector from the excitation codebook 212. The extracted code vector is then passed through the second gain scaling circuit 213 and the second synthesis filter 215 to produce the current decoded signal vector. The coefficients of the second synthesis filter 215 and the gain in the second gain scaling circuit 213 are then updated in the same way as in the encoder 100. The decoded signal vector is then passed through the postfilter 217 to enhance the perceptual quality. The postfilter coefficients are updated periodically using the information available at the decoder 200. The five samples of the postfilter signal vector are next passed to the PCM converter 218 and are converted to five A-law or $\mu$-law PCM output samples. Naturally both the encoder 100 and the decoder 200 utilizes only one and the same of the two mentioned PCM laws.

Figure 4:
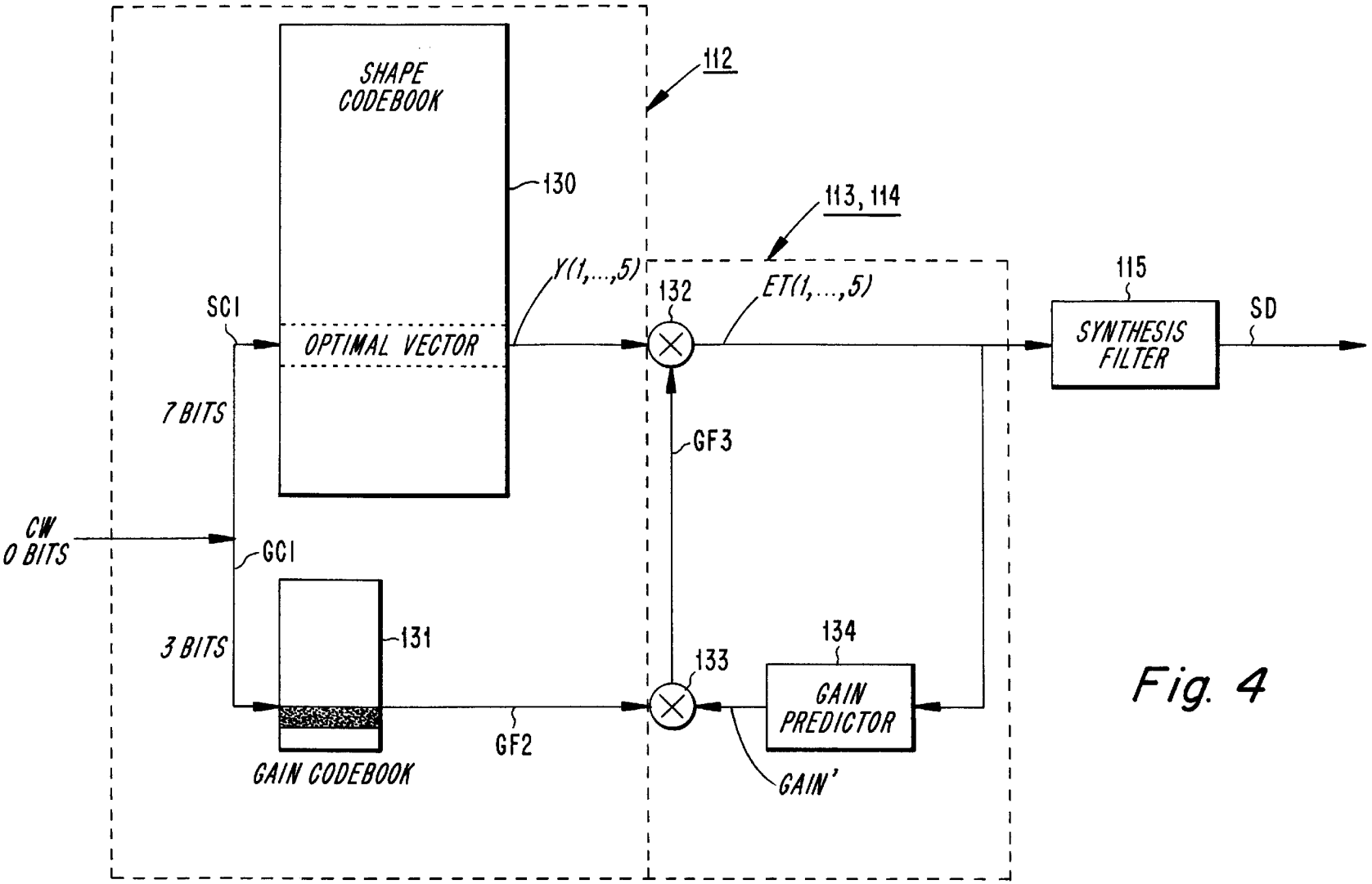
FIG. 4 illustrates in more detail the contents of the local decoder shown in FIG. 2.

FIG. 4 illustrates the generation of the quantized output signal or reconstructed signal in more detail in the local decoder 95 and 96. In FIG. 3*a* the local decoder comprises the synthesis filter 115 and the gain scaling unit 113 with its gain adaptor 114. More in detail the excitation codebook 112 includes a shape codebook 130 and a gain codebook 131 and the circuits 113 & 114 include multiplyers 132 and 133 and a gain predictor 134. The latter generates a gain factor GAIN', the so called excitation vector, and the gain codebook generates a gain factor GF2. In the multiplier 133 a total gain factor GF3 is generated. In other words the gain factor consists of the predicted part GAIN' and the innovation part GF2 which is selected out of eight possible values stored in the gain Codebook 131. In the Local Decoder, the transmitted codeword CW of FIG. 3*a* is split up into the Shape Codebook Index SCI (7 bits) and the Gain Codebook Index GCI (3 bits). The selected excitation vector from the Shape Codebook 130 is multiplied by the gain factor GF3 into the excitation signal ET(1 . . . 5) and is fed through the Synthesis Filter 115. The energy of this excitation signal ET(1 . . . 5) is taken in order to predict the gain of the next excitation vector GAIN'. Therefore, the gain factor GF2 taken from the Gain Codebook is only used in order to correct a possibly erroneous predicted gain factor GAIN'.

Figure 5:
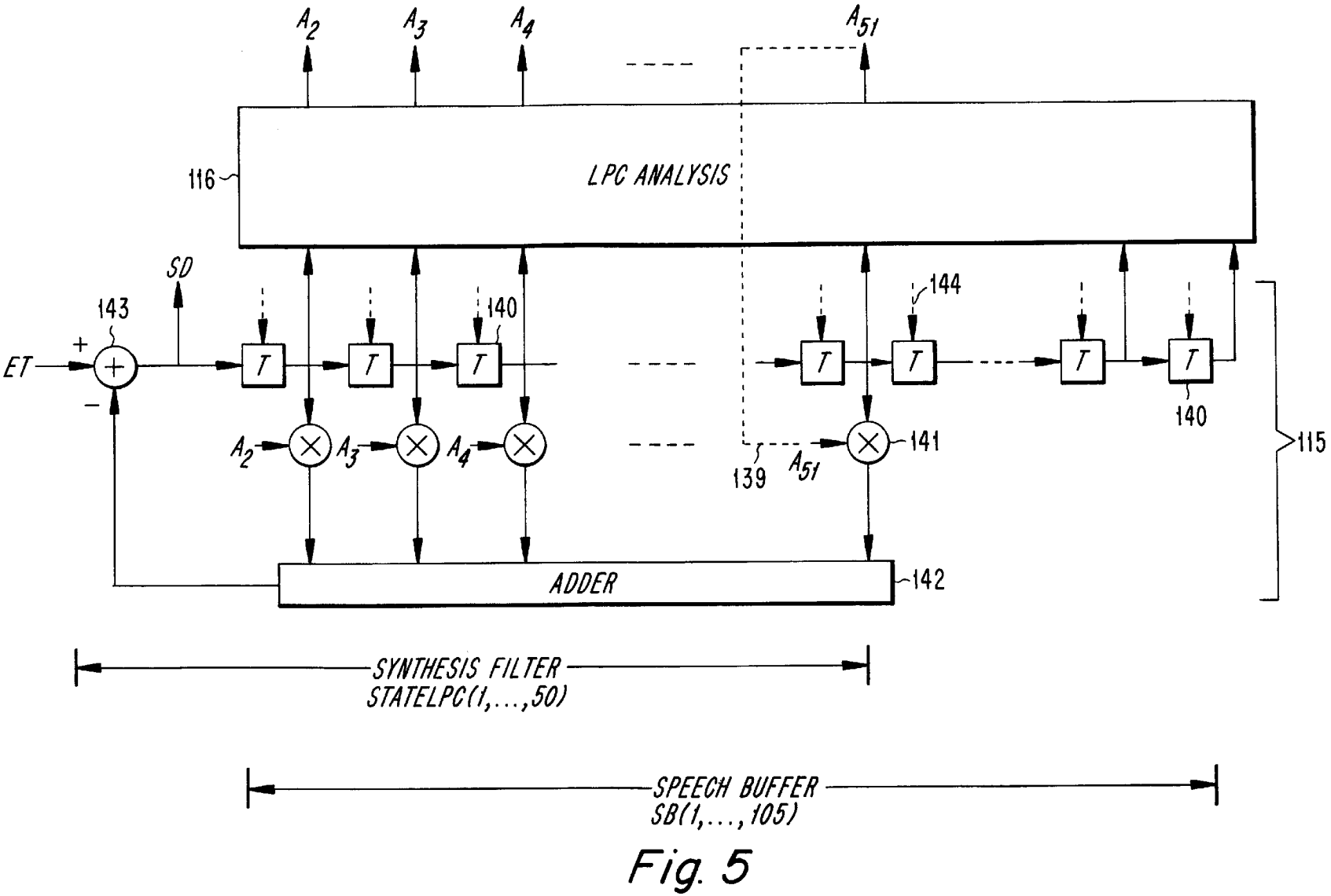
FIG. 5 illustrates in a low level block diagram the backward adaptation of the Synthesis Filter and the corresponding predictor coefficients.

FIG. 5 illustrates in detail the basic principles of backward adaptive linear prediction as used for example in the LD-CELP codec. A delay line has delay elements 140 having each a delay period of one sampling period T. The outputs of the delay elements are connected to each a coefficient element 141 with predictor coefficients $A_2$ to $A_{51}$, the outputs of which are connected to a summing element 142. This element is in turn connected to a difference element 143 which has an input for the excitation signal sequence ET(1 . . . 5) and which is connected to the first delay element 140 of the delay line. Each of the delay elements are connected to an LPC analysis unit which is the backward predictor adaptor 116 of FIG. 3. The delay elements are also connected to the input 144. The adaptor 116 is connected to the respective coefficient elements 141. The connection between the difference element 143 and the delay line has an output for a quantized output signal which is the decoded speech signal SD. The past reconstructed speech samples of the signal SD are stored in the delay line elements 140, 'T' indicating a delay of one sampling period. The most recent samples of this delay line are weighted by the predictor coefficients ($A_1$ . . . $A_{51}$, $A_1$=1) and form together with the excitation signal ET(1 . . . 5) the quantized output signal or decoded speech SD. The newly generated samples SD are then shifted into the delay line. The corresponding predictor coefficients $A_2$ to $A_{51}$ are derived from the past history of the decoded speech by applying well known LPC techniques in the backward predictor adaptor 116. As indicated on FIG. 5 the elements 141 are connected by inputs 139 to the outputs of the adaptor 116. In rec. G.728, the whole delayline consisting of 105 samples is called 'Speech Buffer' and denoted as array 'SB(1 . . . 105)' in the pseudo code. The most recent part of this buffer is called the 'Synthesis Filter' and denoted as 'STATELPC(1 . . . 50)' in the pseudo code.

Figure 6:
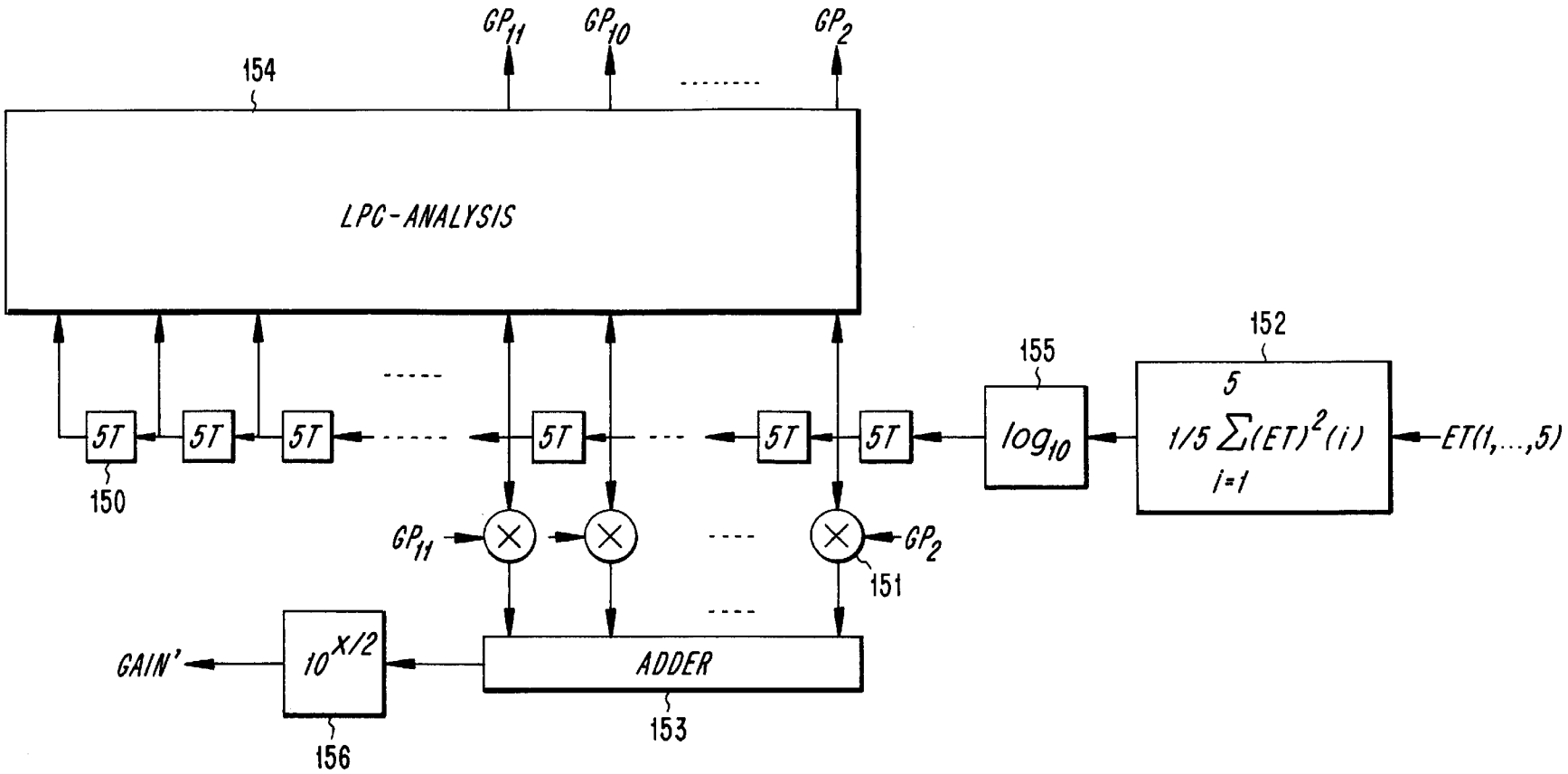
FIG. 6 illustrates in a low level block diagram the backward adaptation of the Gain Predictor and the corresponding predictor coefficients.

FIG. 6, which corresponds to the backward gain adaptor 114 and partly the gain scaling unit 113 of FIG. 3, illustrates in detail the situation in the Gain Predictor part. An energy generating unit 152 is connected to a delay line with delay elements 150, each having a delay of five sampling periods denoted by 5T in the elements. A part of the delay elements 150 are connected to coefficient elements 151 with predictor coefficients $GP_2$ to $GP_{11}$. The coefficient elements are connected to a summator 153, having an output for the signal GAIN'. All of the delay elements 150 are connected to a predictor adaptator 154, the outputs of which are connected to coefficient elements 151. The energy of the excitation signal ET(1 . . . 5) is shifted into the delay line. Again, the most recent values of the energy are weighted by the predictor coefficients ($GP_1$ . . . $GP_{11}$, $GP_1$=1), the sun generated in summator 153 yielding the gain factor GAIN' predicted for the next input signal vector to be encoded. Also here, the corresponding predictor coefficients are derived from the past history of the energy of the excitation signal (1 . . . 5) ET by applying well known LPC techniques in the predictor adaptor 154. By the way, in the LD-CELP codec the state variables of the Gain Predictor are represented in the log. domain as indicated by a units 155 and 156. This may be different in other backward adaptive schemes.

Figure 7A:
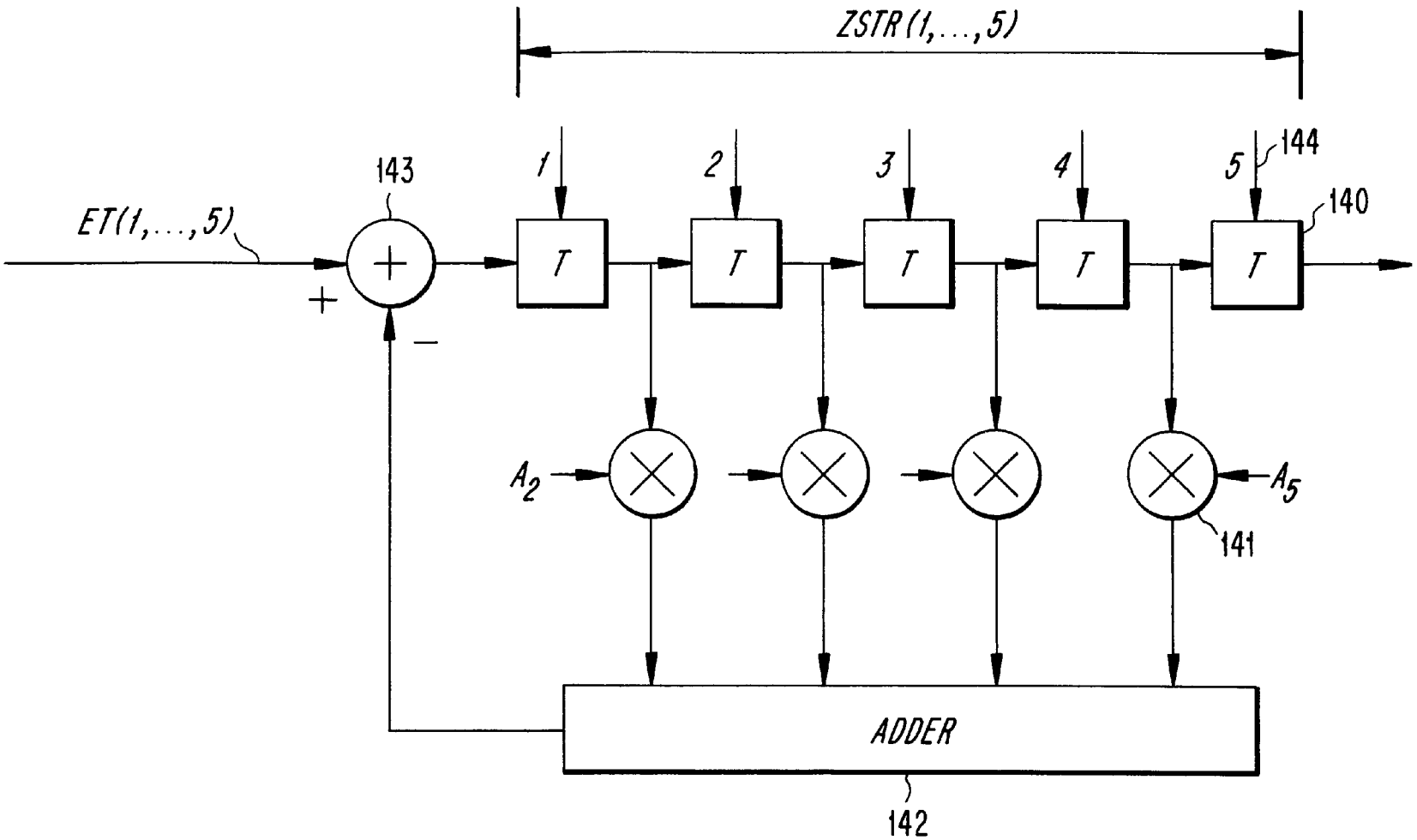
FIG. 7*a* and *b* illustrates the procedure of performing the Synthesis Filter operations in the LD-CELP speech codec.
Figure 7B:
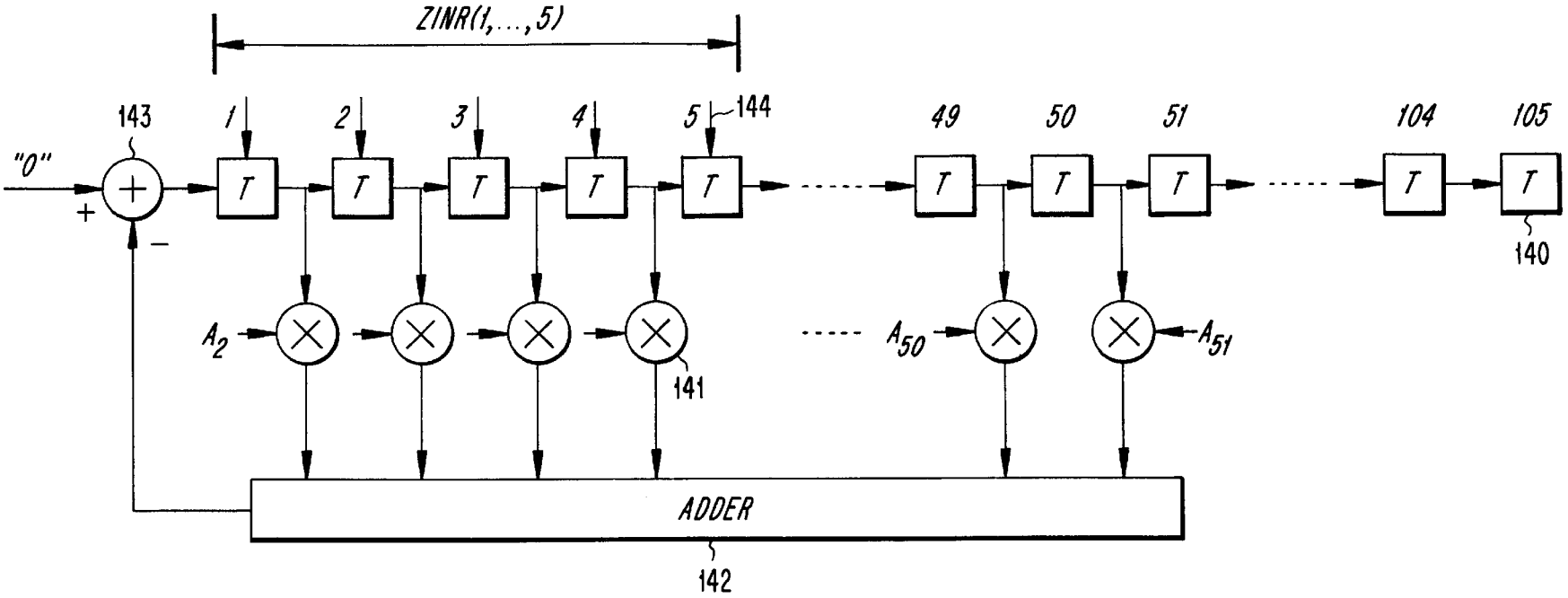

Finally, some knowledge about the procedure of finding the optimum excitation vector ET (1 . . .5) seems to be useful for understanding the details of the invention. Reference is made to FIGS. 7*a* and 7*b* which show parts of the synthesis filter of FIG. 5. FIGS. 7*a* and 7*b* show the synthetis filter operated in different states as described in the ITU Recommendation G.728, page 39 and also indicated in its FIG. 2/G.728 by different blocks 22 and 9 for the synthesis filter. In the LD-CELP codec for example, five succeeding samples are collected forming the vector to be encoded. If a vector is complete, five samples of the ringing of the Synthesis Filter are computed and subtracted from this input speech vector yielding the target vector. Ringing or zero input response ZINR(1 . . . 5) is produced by feeding the Synthesis Filter with zero valued input samples "0", see FIG. 7*b*. This signal can also be seen as the predicted samples for the current speech vector. In the encoder, all 1024 possible excitation vectors of the Shape Codebook 130 combined with the gain codebook 131 are fed through the Synthesis Filter, starting with zero states for each new vector yielding a zero state response ZSTR(1 . . . 5), see FIG. 7*a*. The resulting five samples for each excitation vector are compared against the target vector. Finally, the one is chosen that yields the minimum error. Once the optimum excitation vector is found, the Synthesis Filter states are updated. That is, the zero state response belonging to the chosen excitation vector is added to the zero input response resulting in five new samples of the decoded speech or new five state values of the Synthesis Filter. This update is done in the local decoder on the transmitter side and the receiver side as well.

It should be carefully noted that the above detailed description of the FIGS. 4, 5, 6 and 7 is made for the transmitter side but is to be applicated on the receiver side as well, as appears from the description to FIGS. 1, 2, 3*a* and 3*b*.

After having described above an overview of the invention and having described the most important details of the LD-CELP speech coding scheme, the detailed description of the preferred embodiment of the invention will be given. When a backward adaptive speech codec like the LD-CELP speech codec is to be activated no states of this codec are available, i.e. there are no values available in the delay elements 140 of the delay line in FIG. 5 or in elements 150 of FIG. 6. Only the quantized signal, which was produced by the previously running coding scheme, can be collected. Therefore, in order to obtain smooth transitions, retrieving of the LD-CELP states is performed by taking the history of the past output signal as the basis. In the examplifying embodiment above this history of the past output signal is taken from the VDSC codec, stored in the buffers 192 and 292 of FIG. 1. It should be noted that a voiceband data signal compressing codec, like the examplified VDSC codec 101 and 290, has a delay line with delay elements similar to the elements 140 of the LD-CELP codec in FIG. 5. It is the states in this delay line of the VDSC codecs that are stored in the buffers 192 and 292 and are updated as the processing in the VDSC codecs runs. The values in the buffers are fed parallelly to the elements 140 via their respective input 144.

From FIG. 5 it can be seen that the states of the Synthesis Filter contain the history of the past reconstructed output signal. This is true for the LD-CELP described above and also true for the VDSC codec. When the signal classification circuit 103 of FIG. 1 indicates speech on the line 99 and switches from the VDSC codecs 101 and 290 to the LD-CELP codecs 100 and 200 the updating of the buffers 192 and 292 stop. The switches 193 and 293 are activated for a short moment by the circuit 103 and the state values of the buffers are loaded into the delay elements 140 of the synthesis filter delay line via the inputs 144. So the history of the previously computed speech samples from the buffers 192 and 292 are taken and the Synthesis Filter states of LD-CELP codecs 100 and 200 are preset with these buffer values. The remaining task is then to find the excitation signal ET(1 . . . 5) which would have produced these states, if the LD-CELP would have been running already in the past. When this excitation signal ET(1 . . . 5) is found it would be easy to pre-set the Gain Predictor states described in connection with FIG. 6.

In the following, the algorithmic details are explained by providing pseudo code as used in the ITU recommendation G.728 "Coding of Speech at 16 kbit/s Using Low-Delay Code Excited Linear Prediction". Signals or coefficients are denoted according to TABLE 2/G.728 of the recommendation.

The description of generating the gain predictor states is begun with the procedure of the Synthesis Filter update as is done in the LD-CELP when running in the normal mode. Five samples of the excitation signal ET(1 . . . 5) are fed into the Synthesis Filter in this way: firstly, five samples of the zero input response ZINR(1 . . . 5) are computed, see FIG. 7*b*. This is the output of the Synthesis Filter when fed with zero valued input signal "0" (ringing). Secondly, the five samples of the zero state response ZSTR(1 . . . 5) are computed, see FIG. 7*a*. Note that only five of the states are different from zero. Therefore, only these first five states are drawn in FIG. 7*a*. ZSTR(1 . . . 5) is the output vector of the zero state Synthesis Filter when fed with the excitation signal ET(1 . . . 5). Then the five new values of the Synthesis Filter states STATELPC(1:5) or SB(1:5) are computed by adding the previously generated components:

$$\mathrm{STATELPC}(i)=\mathrm{ZINR}(i)+\mathrm{ZSTR}(i);\ i=1,\ldots,5$$

Keeping this procedure in mind we can derive now the method of retrieving the excitation signal ET(1 . . . 5). When switching from an other codec, e.g. the VDSC codec of FIG. 1, to the LD-CELP codec only the samples in array STATELPC(1 . . . 50) are known by placing the past reconstructed signal into the correct locations of array STATELPC(1 . . . 50) or array SB(1 . . . 105) whereby STATELPC(1 . . . 50) can be seen as a part of array SB(1 . . . 105) in FIG. 5. The excitation signal ET(1 . . . 5) is hidden in the values of the zero state response stored in ZSTR(1 . . . 5) which has to be isolated at first. For this purpose the zero input response ZINR(1 . . . 5) must be generated by feeding the Synthesis Filter with five zero valued samples. Then, the zero state response can be extracted by generating $$\mathrm{ZSTR}(i)=\mathrm{STATELPC}(i)-\mathrm{ZINR}(i);\ i=1,\ldots,5$$

ZSTR(i) is the output of the zero state Synthesis Filter when it would be fed with the excitation signal ET(1 . . . 5). This vector can be derived now by applying the inverse filter operation upon this zero state response. The excitation signal ET(1 . . . 5) can be reconstructed perfectly since the samples of the zero state response do not contain all the components of a continuously running convolution process with fifty predictor coefficients. This last step of retrieving the excitation signal ET(1 . . . 5) from the zero state response ZSTR(1 . . . 5) can be recognised more clearly when the corresponding operations are explained by the aid of a piece of pseudo code. In Table 1 the pseudo code for the computation of the zero state response as it is performed according to the recommendation G.728 is shown in the left column. In the right column the corresponding inverse operations for retrieving the excitation vector are shown as the inverse filter operation.

Table 1: Invers operation of the 'zero state response computation'

| Zero State Response computation | → Inverse Filter operation |
|---|---|
| 1)ZSTR(1)=ET(1) | → 1)ET(1)=ZSTR(1) |
| 2)ZSTR(2)=ET(2)−$A_2$·ZSTR(1) | → 2)ET(2)=ZSTR(2)+$A_2$·ZSTR(1) |
| 3)ZSTR(3)=ET(3)−$A_3$·ZSTR(1)− −$A_2$·ZSTR(2) | → 3)ET(3)=ZSTR(3)+$A_3$·ZSTR(1)+ +$A_2$·ZSTR(2) |
| ..... | ..... |

Once having the excitation signal ET(1 . . . 5) the corresponding state values of the Gain Predictor can be generated as recommended for example in Block 20 of G.728 "1-vector delay, RMS calculator and logarithm calculator". So all signals are available that are required in order to achieve a smooth transition from any other codec to the LD-CELP type speech codec. This generation of the gain states will be shortly repeated below. The exitation signal ET(1 . . . 5) is fed to the energy generating unit 152 of FIG. 5, the delay elements 150 are filled up with the gain predictor states, the coefficients $GP_2$–$GP_{11}$ in the coefficient elements 151 are generated and the gain excitation vector GAIN' is generated. At the very beginning of the speech transmission a codewector CW is generated and coupled back to the excitation codebook 112, a new value of the excitation signal ET(1 . . . 5) is generated as described to FIG. 4, the states of the synthesis filter are updated as also the synthesis filter predictor coefficients $A_2$ to $A_{51}$ in the coefficient elements 141 and a new value SD of the decoded speech is generated. A new value of the gain exitation vector GAIN' is generated for the next codewector CW. In this way the states of the LD-CELP are successively updated for the speech tansmission.

Figure 8:
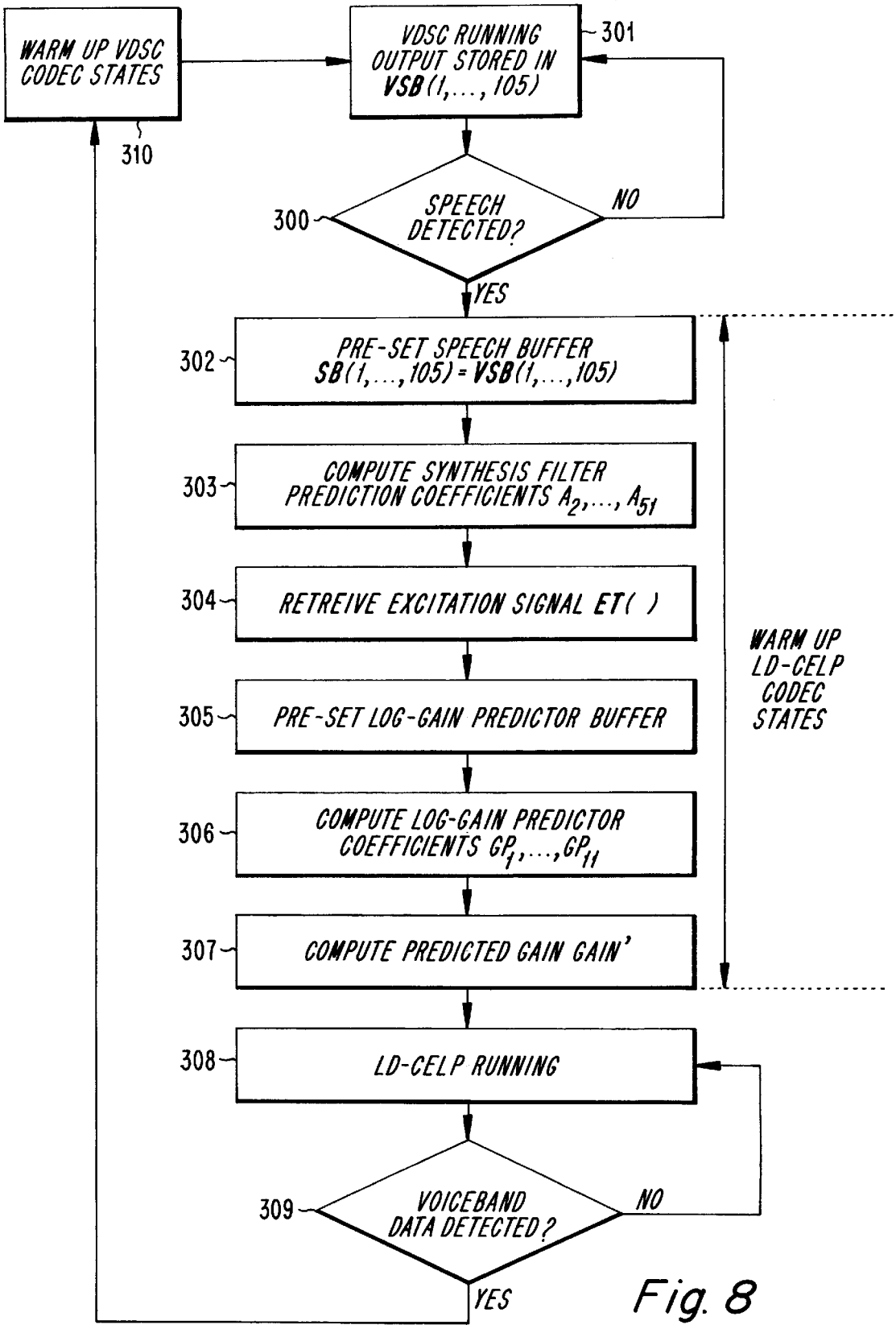
FIG. 8 shows in a flow diagram the procedure of warming up the states in a LD-CELP type speech codec.

An overview of the inventive method will now be described in connection with the flow diagram of FIG. 8. The flow diagram illustrates the procedure of switching between two different speech codecs providing a smooth transition in the decoded output signal. The method starts in block 300 with the signal classification circuit 103 detecting if speech is transmitted. For an alternative NO the VDSC codec goes on coding data for transmission according to a block 301. For an alternative YES the speech buffer, elements 140, in the LD-CELP codec are preset with state values VSB(1 . . . 105) from the VDSC codec, stored in buffer 192, according to a block 302. Synthesis filter predictor coefficients $A_2$ . . . $A_{51}$ are generated, block 303. The excitation signal ET(1 . . . 5) is retrieved, block 304, and in a block 305 the gain predictor buffer, elements 150 of FIG. 6, is preset. The gain predictor coefficients, GP1 to GP11, are generated in block 306 and the gain excitation vector GAIN' is generated in a block 307. The LD-CELP codec 100 and 200 are running, as to block 308, and speech is transmitted between the transmitter and the receiver. Block 309 shows that the signal classification circuit 103 continuously detects if voiceband data is transmitted. In an alternative NO (to voiceband data!) the LD-CELP codecs keep running. In an alternative YES the VDSC codecs are copled to the transmission line 120 and starts coding the indicated data for transmission.

It should now be observed that the coding scheme of the VDSC codec also can be a backward adaptive coding scheme. In such case the VDSC codec can be started up by presetting the state values in the VDSC codec with the state values from the area SB(1 . . . 105) in the LD--CELP codec. This is indicated with a block 310 in FIG. 8. In this way the invention can be utilised for both the speech and data codecs in a transmission line. Also other codecs with backward adaptive coding schemes can utilize the invention.

Figure 9:
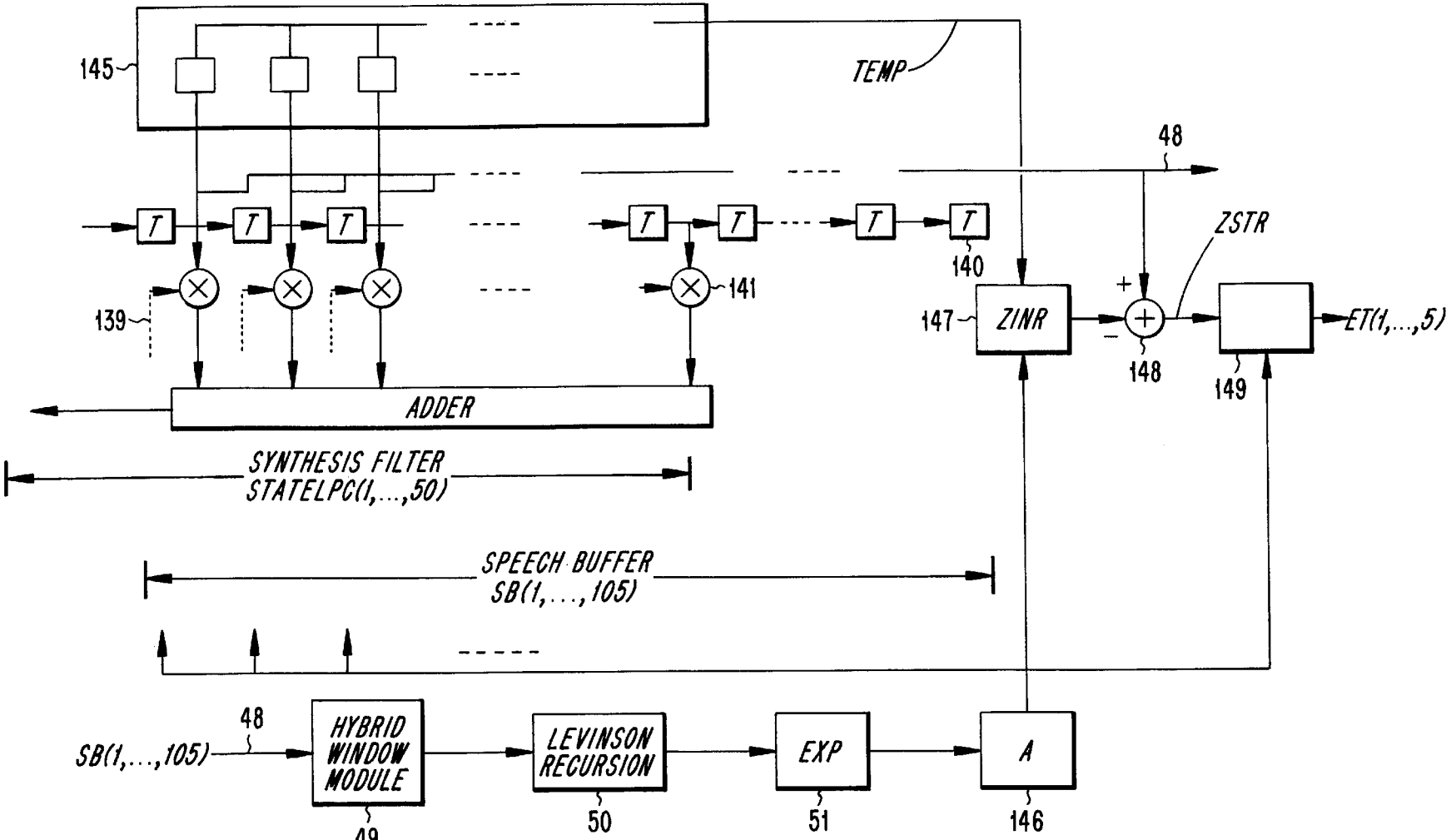
FIG. 9 shows a block diagram for generating of an excitation vector.

The generation of the exitation signal ET(1 . . . 5) will now be described in connection with FIG. 9, before the very detailed description is made below in pseudo code. The state values from the VDSC codec are parallelly stored in the elements 140 of the speech buffer SB(1 . . . 105). A temporary copy of a part of the speech buffer is stored in a memory 145 and a signal TEMP is outputted after a processing described more in detail below in pseudo code. The complete content of the speech buffer SB(1 . . . 105) is sent to a hybride window unit 49 via a connection 48. By hybride windowing in the unit 49, Levinson recursion in a unit 50 and bandwidth expansion in block 51 the predictor coefficients $A_2$ to $A_{51}$ are generated and stored in a memory 146. The values $A_2$ . . . $A_{51}$ are sent to the respective coefficient elements 141 via the inputs 139. Zero input response values ZINR(1 . . . 5) are generated in a unit 147 with the aid of the signal TEMP and the A-coefficients from memory 146. Zero state response values ZSTR(1 . . . 5) are generated in a difference unit 148, and in a unit 149 the values of the excitation signal ET(1 . . . 5) are generated. These values are sent to the energy generating unit 152. Values of the decoded speech signal SD can now be generated, at the beginning of the process with the aid of the A-factors from the memory 146, stored in coefficient elements 141 and with the aid of the states from the VDSC codec 101 stored in the elements 140.

In a simplified embodiment of the invention the coefficient values $A_2$ to $A_{51}$ are not generated in units 49, 50, 51 and 146. Instead corresponding coefficients, B2 to B51 of FIGS. 3*a* and 3*b*, in the VDSC codec are transferred to the LD-CELP codec and are inserted into the coefficient units 141 via the inputs 139.

In DCME transmission schemes it is known that erroneous decisions in the signal classification algorithm could result in switching from one coding scheme to the other at every 2.5 msec. If the other coding scheme would be as expensive as the LD-CELP there would be no chance to equalise the computation power available within 5 msec between the two coding schemes since the operations of pre-setting the states and the calculations of the normal operating mode must be performed. Therefore, when turning on the LD-CELP the computation power available within the 2.5 msec must be shared between the initialisation phase and succeeding normal operation phase. Both together should require not more computation power than is used during the normal operation mode. In the following, methods for reducing the complexity during the startup phase and also during the first adaptation cycles are described.

During the initialization phase, the computational load of copying past samples into the state variables of the Synthesis Filter is negligible. The Gain Predictor states update would be slightly more expensive. Much more computation power, however, would be required for the computation of the predictor coefficients $A_1$ to $A_{51}$ of the Synthesis Filter. Hybrid windowing and Levinson Recursion procedures would demand for an enormous peak of processor power.

One way of reducing complexity in this part is to change the predictor order of the Synthesis Filter to values of about ten during the initial phase only so that only coefficients up to $A_{11}$ are generated. Periods of slightly degraded speech can be hardly recognized as long as the signal is slightly affected for a few milliseconds only. This is the case here since the speech buffer SB(1 . . . 105) can be filled by past samples immediately. A first complete set of fifty predictor coefficients is available at most after 30 samples or 3.75 msec. A reduced filter order has the advantage of low complexity in the computation of the zero state responses during the initialization phase. For each new sample of the zero state response fifty muliply-add operations must be performed as can be seen from FIG. 7*b*. This computational cost is reduced by a factor of 5 if a reduced filter order of 10 is applied.

Another method would be to use the coefficients, corresponding to the coefficients $A_1$ to $A_{51}$ of the LD-CELP codec, previously generated by the other coding scheme VDSC. This saves significant computation power required for computing windowing, ACF coefficients and Levinson Recursion.

Furthermore, the computation power required for the coefficients update during the first adaptation cycle after starting the LD-CELP could be stolen and transferred to the initialisation part. The predictor coefficients computed in advance are then frozen during the first or the first two adaptation cycles. The resulting degradation in speech quality is negligible, the gain in computation power however is significant.

Additional complexity reduction can be achieved in the Gain Predictor section of the LD-CELP. The gain predictor states in the elements 150 of the LD-CELP codec consist of ten taps. Therefore, at least ten succeeding vectors of the excitation signal ET(1 . . . 5) should be derived from the Synthesis Filter states. In addition, predictor coefficients $GP_2 \ldots GP_{11}$ should be derived in order to predict the gain for the first vector of the first adaptation cycle following the initialisation phase. Fortunately, the Gain Predictor states are less sensitive to minor distortions. This allows a pre-set with only roughly estimated values. So, the following modifications can be made in order to reduce complexity during the initial phase:

Compute the gain GAIN' for the latest excitation vector ET(1 . . . 5) only and assume that this would be the mean value for the past and also the predicted value for the first vector of the first adaptation cycle. By the way, a new set of predictor gains is already computed during the first vector of the first adaptation cycle. So, a pre-set of $GP_2 \ldots GP_{11}=0$ would be sufficient.

A slightly more expensive method would be to compute a few of the latest log-gains and taking the mean value of the results for the current and the past gain.

Now the preferred embodiment for one of many other possible combinations is explained in detail by using the pseudo code as also applied in recommendation G.728. Shown is the step when switching from any other coding algorithm to the LD-CELP has to be carried out.

Let us assume that the other coding algorithm has generated quantized output samples VS in the past and that the history of this signal is being stored in an array labelled VSB(1:105) whereby VSB(105) contains the oldest and VSB(1) the latest sample. All other labels mentioned below are the same as used in recommendation G.728. Then, when the LD-CELP will be in turn the following operations are performed in advance:

1. Copy samples from array VSB(1 . . . 105) into SB(1 . . . 105); SB(1 . . . 50) is identical with the Synthesis Filter state variables stored in STATELPC(1 . . . 50) whereby the latest sample is stored in STATELPC(1).

2. Compute 51 predictor coefficients A(1 . . . 51) whereby A(1)=1 by running the Hybrid Windowing Module (Block 49), the Levinson Recursion Module (Block 50) and the Bandwidth Expansion Module (Block 51). These coefficients are used during the initialization phase for the computation of zero input responses and during the first adaptation cycle.

3. The Gain Predictor states are pre-set by computing only the log-gain of the latest excitation vector and by copying this value into the other locations of SBLG( ) or GSTATE( )

a) Compute five samples of the zero input response:

| | |
|---|---|
| For k=1,2,..,50<br>TEMP(k)=SB(k+5) | make a temporary copy |
| FOR k=1,2,...,5<br>{ZINR(k)=0<br>For i=2,3,...,50<br>{ZINR(k)=ZINR(k)−TEMP(k+i−2)·$A_i$<br>TEMP(i)=TEMP(i−1)}<br>ZINR(k)=ZINR(k)−TEMP(k+49)·$A_{51}$<br>TEMP(1)=ZINR(k)} | STATELPC() can be implemented such that is part of array SB().<br>So instead of STATELPC(), array SB() is used only in the following. |

b) Compute five samples of the zero state response:

For k=1,2, . . . ,5
ZSTR(k)=SB(k)−ZINR(k)

c) Compute five samples of the excitation vector by inverse filter operation:

ET(1)=ZSTR(1)
For k=2,3, . . . ,5
{ET(k)=ZSTR(k)
For i=2, . . . ,k
ET(k)=ET(k)+ZSTR(k−i+2)·$A_1$} d) Blocks 76, 39,40 (computation of log-gain)

ETRMS=ET(1)·ET(1)
For k=2,3, . . . ,5
ETRMS=ETRMS+ET(k)·ET(k)
ETRMS=ETRMS DIMINV
IF(ETRMS<1)ETRMS=1
ETRMS=10·$\log_{10}$(ETRMS)

e) Fill Gain Predictor states with log-gain:

| | |
|---|---|
| For i=1,2,..,33<br>SBLG(i)= ETRMS-GOFF<br>GAINLG=SBLG(33)+GOFF<br>GAIN'=$10^{(GAINLG/20)}$ | GSTATE() can be implemented in such a way that is part of array SBLG(). Therefore it is not pre-set separately.<br>Predicted gain values for the first vector of the first adaption cycle. |

f) On the encoder side only: Perform shape codevector convolution and energy table calculation (Blocks 12, 14, 15):

For the computation of the impulse response the weighting filter is not required at this time. Therefore, the contributions of AWZ( ) and AWP( ) of Block 12 can be withdrawn.

This proposed procedure in combination with the operations performed during first adaptation cycle is not more expensive than the computational load would be without the preset. This holds specially if the Levinson recursion (Block 50) is spread over several vectors as is usually done in practical implementations.

The ITU recommendation G.728, referred to above, is annexed to the description.

I claim:

1. A method in a transmission system for transmitting signals over a communication channel, the system comprising:

a first backward adaptive encoder including a synthesis filter having elements for filter states and also having coefficient elements for predictor coefficients;

a second backward adaptive encoder having elements for state values; and a control circuit for switching between said first and second encoders in selecting that one of the encoders which is to be utilized in the transmission;

said method comprising:

transmitting signals via the second encoder and storing its state values in a buffer;

switching, with the aid of the control circuit, for transmission via the first encoder;

pre-setting at least a part of the state values of the first encoder with said stored state values;

bringing forth at least a part of the predictor coefficients in the first encoder; and generating an output signal from the synthesis filter in dependence on the predictor coefficients ($A_2 \ldots A_{51}$) brought forth.

2. A method according to claim 1, the second encoder having coefficient elements for predictor coefficients, corresponding to the coefficient elements of the first encoder, and the method further comprising:

storing at least a part of the predictor coefficients of the second encoder in said buffer; and transmitting said stored predictor coefficients (B2 . . . B51) to the coefficient elements of the synthesis filter in the first encoder.

3. A method according to claim 1 comprising generating the predictor coefficients of the first encoder with the aid of said pre-set state values.

4. A method according to claim 3 comprising generating only a part of the predictor coefficients.

5. A method according to claim 1 further comprising the steps of:

generating vectors included in a response on zero valued input samples to the synthesis filter with the aid of the state values and the predictor coefficients in the synthesis filter;

generating vectors for a zero state response by subtracting said vectors of the response on the zero valued input samples from the corresponding state values of the synthesis filter, divided up as state vectors; and generating an excitation signal for the synthesis filter with the aid of the zero state response vectors.

6. A method according to claim 5, the first encoder having a gain predictor with elements for state values and also coefficient elements for predictor coefficients, said method further comprising:

generating and presetting the state values of the gain predictor by utilizing said generated excitation signal;

generating said predictor coefficients of the gain predictor with the aid of its state values and generating a predicted gain factor for a first of the excitation signals of the synthesis filter after an initiation period for the first encoder.

7. A method in a transmission system for receiving signals transmitted over a communication channel, the system comprising:

a first backward adaptive decoder including a synthesis filter having elements for filter states and also having coefficient elements for predictor coefficients;

a second backward adaptive decoder having elements for state values; and a control circuit for switching between said first and second decoders in selecting that one of the decoders which is to be utilized in the signal receiving;

said method comprising:

receiving signals via the second decoder and storing its state values in a buffer;

switching, with the aid of the control circuit, for receiving via the first decoder;

pre-setting at least a part of the state values of the first decoder with said stored state values;

bringing fort at least a part of the predictor coefficients in the first decoder; and generating an output signal from the synthesis filter in dependence on the predictor coefficients brought forth.

8. A method according to claim 7, the second decoder having coefficient elements for predictor coefficients, corresponding to the coefficient elements of the first decoder, and the method further comprising:

storing at least a part of the predictor coefficients of the second decoder in said buffer; and transmitting said stored predictor coefficients to the coefficient elements of the synthesis filter in the first decoder.

9. A method according to claim 7 comprising generating the predictor coefficients of the first decoder with the aid of said pre-set state values.

10. A method according to claim 9 comprising generating only a part of the predictor coefficients.

11. A method according to claim 7 further comprising the steps of:

generating vectors included in a response on zero valued input samples to the synthesis filter, with the aid of the state values and the predictor coefficients in the synthesis filter;

generating vectors for a zero state response by subtracting said vectors of the response on the zero valued input samples from the corresponding state values of the synthesis filter, divided up as state vectors; and generating an excitation signal for the synthesis filter with the aid of the zero state response vectors.

12. A method according to claim 11, the first decoder having a gain predictor with elements for state values and also coefficient elements for predictor coefficients, said method further comprising:

generating and pre-setting the state values of the gain predictor by utilizing said generated excitation signal;

generating said predictor coefficients of the gain predictor with the aid of its state values and generating a predicted gain factor for a first of the excitation signals of the synthesis filter after an initiation period for the first decoder.

13. An apparatus in a transmission system for transmitting signals over a communication channel, the apparatus comprising:

a first backward adaptive encoder including a synthesis filter having elements for filter states and also having coefficient elements for predictor coefficients;

a second backward adaptive encoder having elements for state values;

a control circuit with switches for coupling in one of said first and second encoders to the communication channel;

a buffer for storing the state values of the second encoder when transmitting signals via said second encoder;

means for feeding at least a part of said stored state values into the elements for the state values of the first encoder when swithing for transmission over the communication channel via the first encoder;

a device, connected to inputs of the coefficient elements, for bringing forth at least a part of the predictor coefficients of the first encoder; and a device connected to the coefficient elements for generating an output signal from the synthesis filter.

14. An apparatus according to claim 13 comprising:

coefficient elements in the second encoder for predictor coefficients, said coefficient elements corresponding to the coefficient elements of the first encoder;

means in said buffer for storing the predictor coefficients of the second encoder; and means for transmitting said stored predictor coefficients to the coefficient elements of the synthesis filter.

15. An apparatus according to claim 13, the device for bringing forth the predictor coefficients comprises means for generating said predictor coefficients with the aid of said stored state values in the elements for the state values of the first encoder.

16. An apparatus according to claim 15, said means for generating the predictor coefficients is arranged to generate only a part of the predictor coefficients.

17. An apparatus according to claim 13 comprising:

means for generating vectors with the aid of the states and the predictor coefficients of the synthesis filter vectors being included in a response on zero valued input samples to the synthesis filter;

means for generating vectors for a zero state response, said means including a subtracting device subtracting the vectors for the response on the zero valued inpyt samples from the corresponding state values of the synthesis filter, said state values being divided into state vectors; and means for generating an excitation signal of the synthesis filter with the aid of the vectors for the zero state response.

18. An apparatus according to claim 17, the first encoder including a gain predictor having elements for state values and also having coefficient elements for predictor coefficients, said apparatus comprising:

means for generating and pre-setting of the state values of the gain predictor, utilizing the generated excitation signal means connected to the elements for the state values and also connected to the coefficient elements, said means generating the coefficients of the gain predictor with the aid of the state values of the gain predictor; and means for generating a predicted gain factor for a first of the excitation signals of the synthesis filter after an initiation period for the first encoder.

19. An apparatus in a transmission system for receiving signals transmitted over a communication channel, the apparatus comprising:

a first backward adaptive decoder including a synthesis filter having elements for filter states and also having coefficient elements for predictor coefficients;

a second backward adaptive decoder having elements for state values;

a control circuit with switches for coupling in one of said first and second decoders to the communication channel a buffer for storing the state values of the second decoder when transmitting signals via said second decoder;

means for feeding at least a part of said stored state values into the elements for the state values of the first decoder when swithing for transmission over the communication channel via the first decoder;

a device, connected to inputs of the coefficient elements, for bringing forth at least a part of the predictor coefficients of the first decoder; and a device connected to the coefficient elements for generating an output signal from the synthesis filter.

20. An apparatus according to claim 19 comprising:

coefficient elements in the second decoder for predictor coefficients, said coefficient elements corresponding to the coefficient elements of the first decoder;

means in said buffer for storing the predictor coefficients of the second decoder; and means for transmitting said stored predictor coefficients to the coefficient elements of the synthesis filter.

21. An apparatus according to claim 19, the device for bringing forth the predictor coefficients comprises means for generating said predictor coefficients with the aid of said stored state values in the elements for the state values of the first decoder.

22. An apparatus according to claim 21, said means for generating the predictor coefficients is arranged to generate only a part of the predictor coefficients.

23. An apparatus according to claim 19 comprising:

means for generating vectors with the aid of the states and the predictor coefficients of the synthesis filter, said vectors being included in a response on zero valued input samples to the synthesis filter;

means for generating vectors for a zero state response, said means including a subtracting device subtracting the vectors for the response on the zero valued inpyt samples from the corresponding state values of the synthesis filter, said state values being divided into state vectors; and means for generating an excitation signal of the synthesis filter with the aid of the vectors for the zero state response.

24. An apparatus according to claim 23, the first decoder including a gain predictor having elements for state values and also having coefficient elements for predictor coefficients, said apparatus comprising:

means for generating and presetting of the state values of the gain predictor, utilizing the generated excitation signal;

means connected to the elements for the state values and also connected to the coefficient elements, said means generating the coefficients of the gain predictor with the aid of the state values of the gain predictor; and means for generating a predicted gain factor for a first of the excitation signals of the synthesis filter after an initiation period for the first decoder.

* * * * *